United States Patent [19]

Fischer

[11] 4,302,052

[45] Nov. 24, 1981

[54] MODULAR HYDRAULIC MINING TOOL WITH SLURRY INLET METERING

[75] Inventor: William Fischer, Fullerton, Calif.

[73] Assignee: Chem-Struct Corporation, Orange, Calif.

[21] Appl. No.: 194,834

[22] Filed: Oct. 7, 1980

[51] Int. Cl.[3] ..... E21C 45/00

[52] U.S. Cl. ..... 299/67; 175/67; 299/17; 37/62

[58] Field of Search ..... 299/17, 18, 56, 64, 299/67; 175/67, 102, 213, 238; 37/61, 62, 65; 406/61

[56] References Cited

U.S. PATENT DOCUMENTS

| | | | |
|---|---|---|---|
| Re. 28,945 | 8/1976 | Miscovich et al. | 299/17 |
| 469,841 | 3/1892 | McDougall | 37/65 X |
| 1,379,815 | 5/1921 | Hall | 166/146 |
| 3,155,177 | 11/1964 | Fly | 175/67 |
| 3,909,960 | 10/1975 | Casciano | 37/65 X |
| 4,061,399 | 12/1977 | Nelson | 299/18 |
| 4,074,779 | 2/1978 | Cheung et al. | 175/67 X |
| 4,077,671 | 3/1978 | Bunnelle | 299/17 |

FOREIGN PATENT DOCUMENTS

| | | | |
|---|---|---|---|
| 54646 | 3/1967 | German Democratic Rep. | 175/238 |

*Primary Examiner*—Ernest R. Purser
*Attorney, Agent, or Firm*—Kit M. Stetina

[57] ABSTRACT

An improved hydraulic mining tool is disclosed wherein the major components of the tool are formed as separate discrete modules, each including a high torsional strength common mounting flange which permits the modules to be interchangeably attached to one another in varying axial orientations to yield a composite mining tool structure adapted to meet the particular mining requirements of the mineral formation. The mining tool discloses axial and radial slurry inlets, both of which include means for feeding quantities of mined minerals toward the slurry pump of the tool. The feeding means may be adjusted from ground surface during the mining operation to meter the amount of material entering into the slurry pump, thereby maximizing mining efficiency in varying consistency mineral formations.

19 Claims, 15 Drawing Figures

Fig. 3
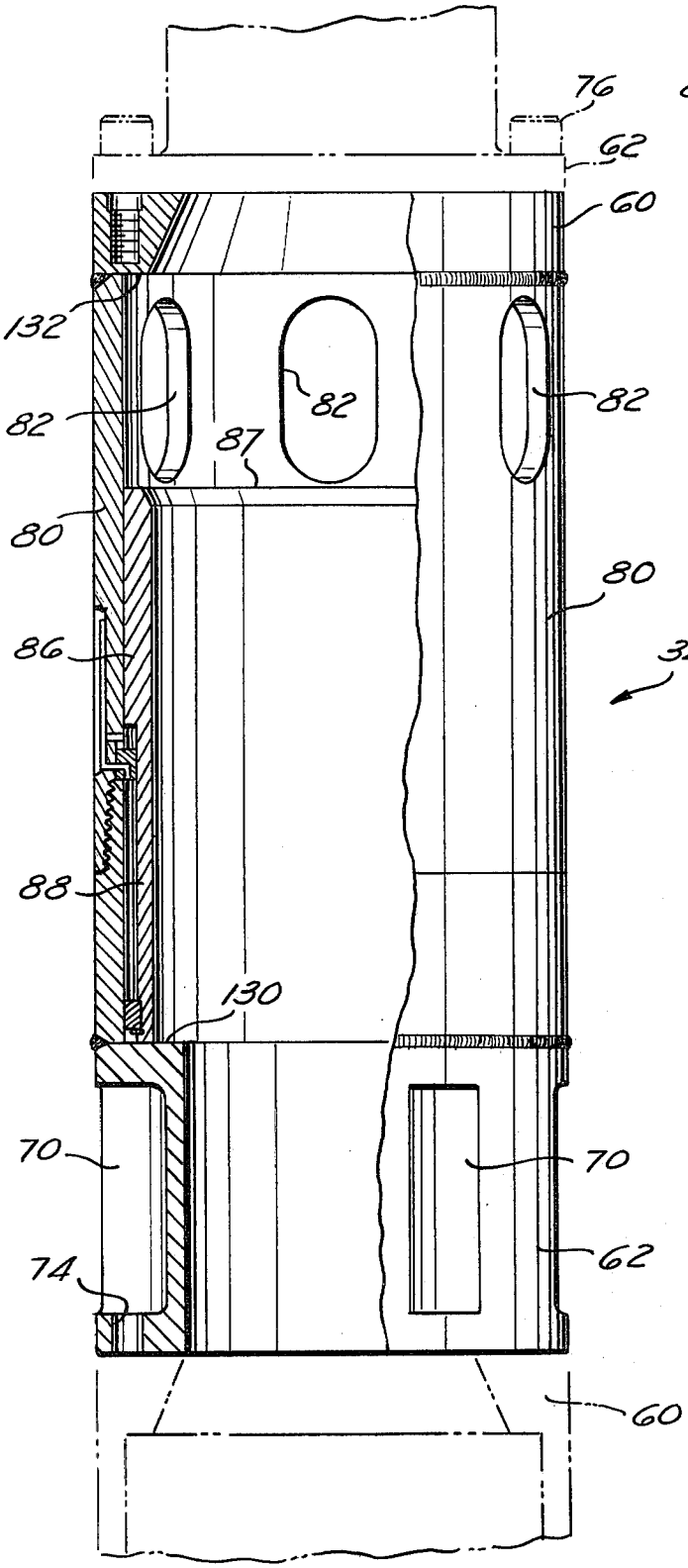
Fig. 4
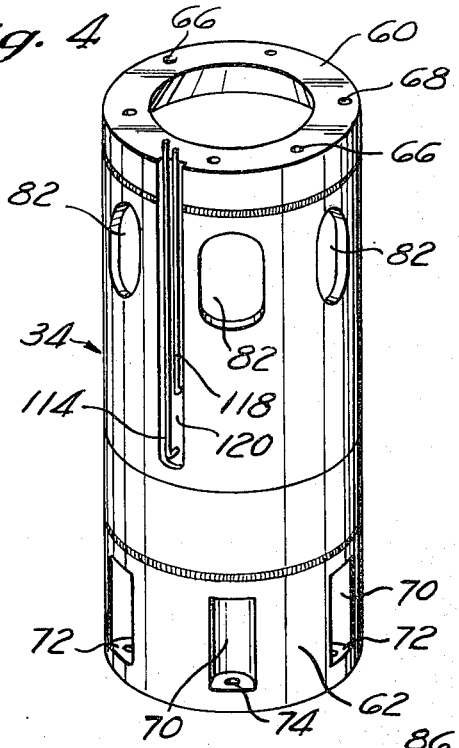
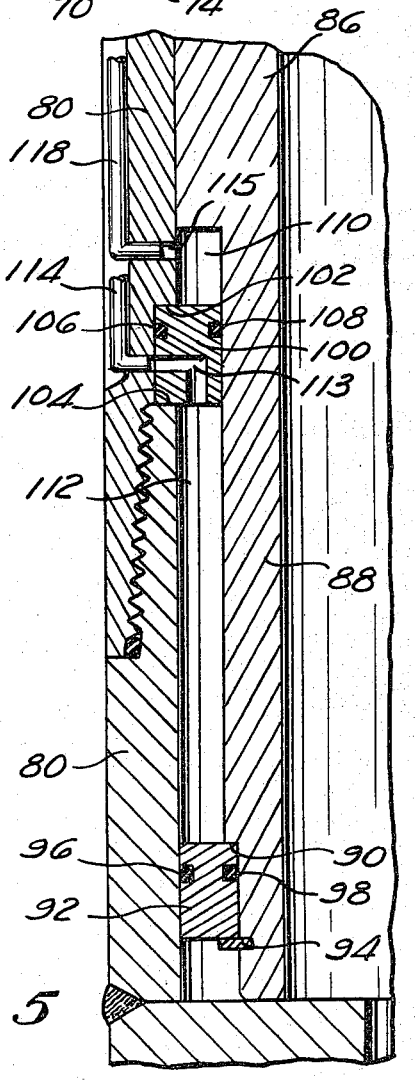
Fig. 5

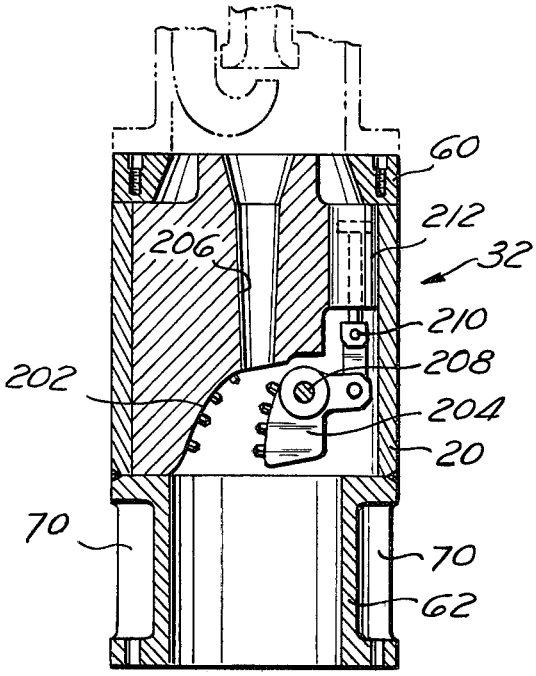
Fig. 10
Fig. 12
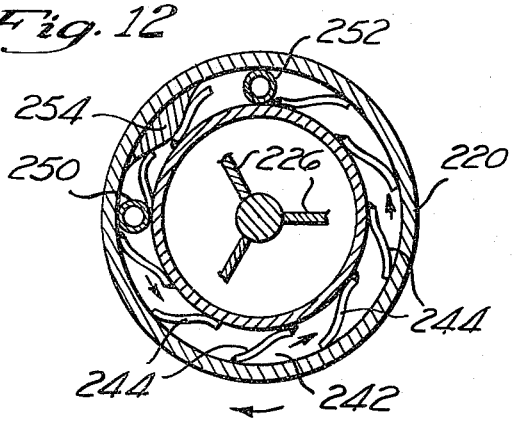
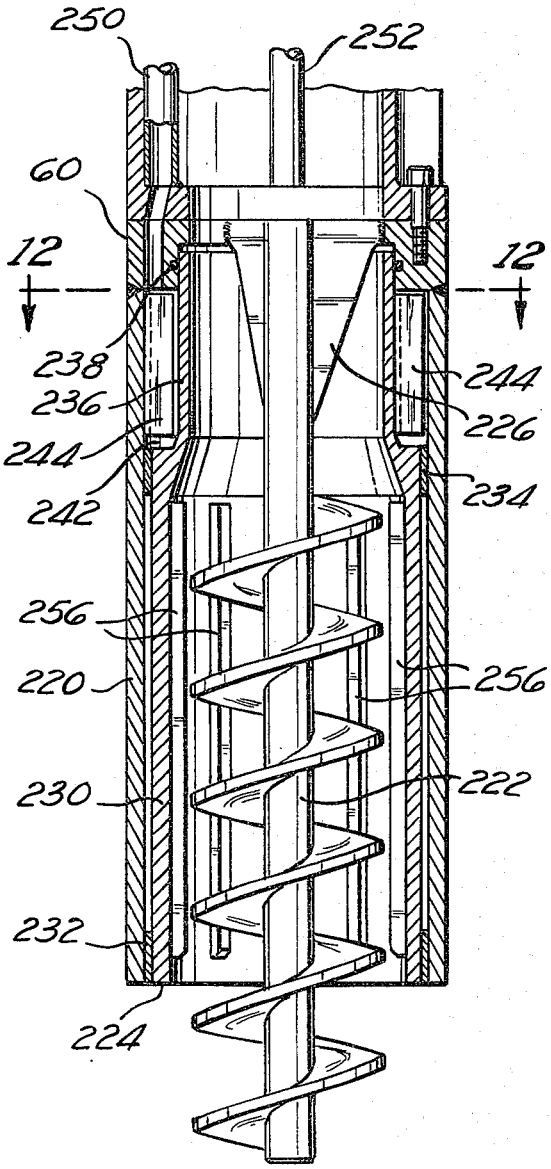
Fig. 11

Fig. 14
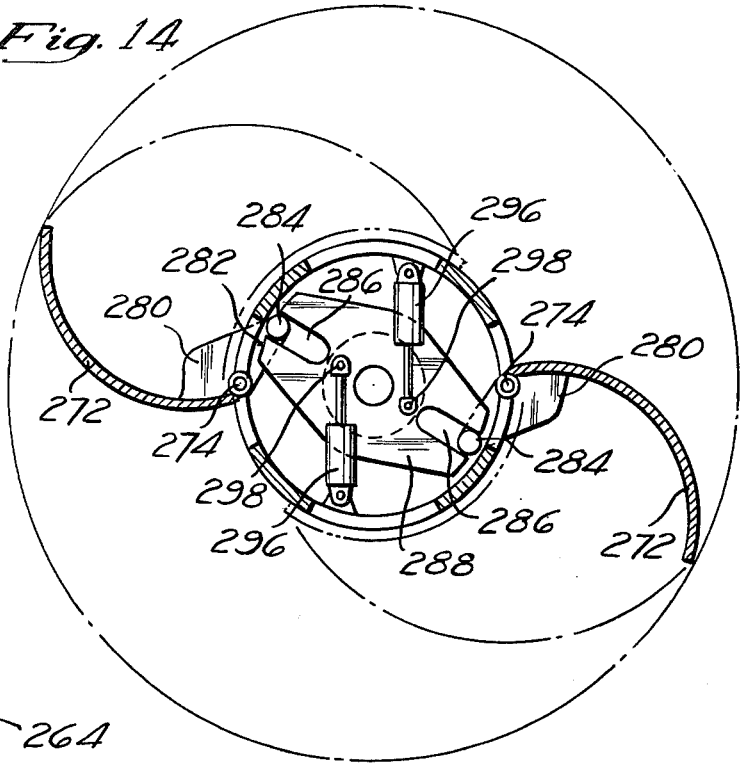
Fig. 13
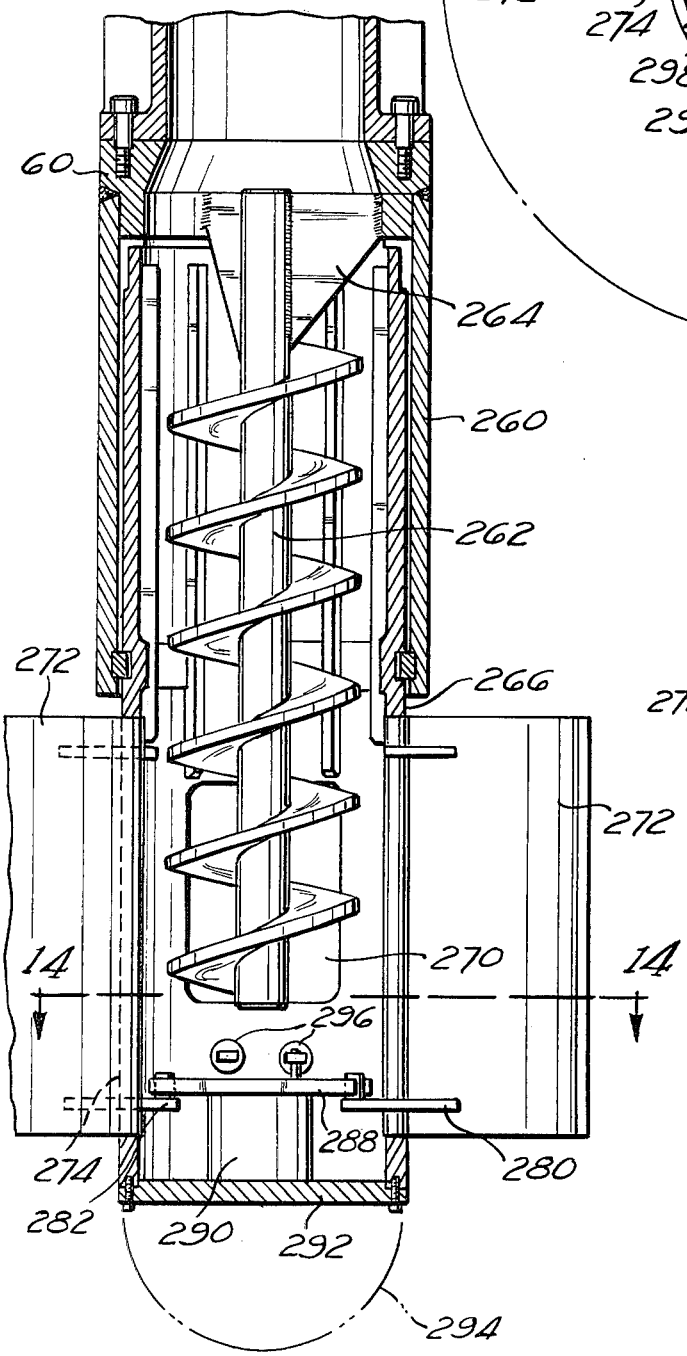
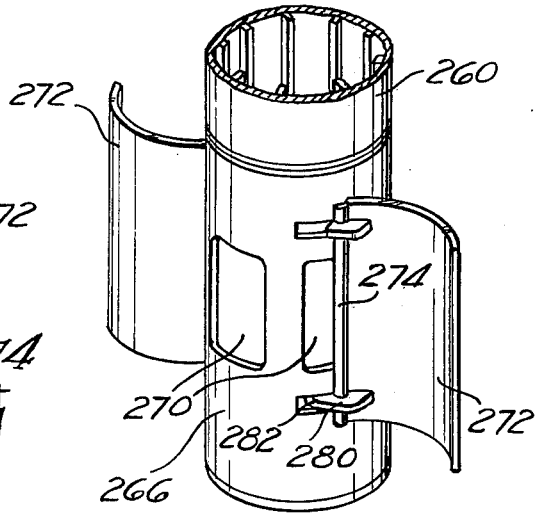
Fig. 15

MODULAR HYDRAULIC MINING TOOL WITH SLURRY INLET METERING

BACKGROUND OF THE INVENTION

The present invention relates to apparatus and methods for hydraulically mining mineral deposits, and more particularly, to a modular hydraulic mining tool and improved method of hydraulically mining high viscosity crude oil mineral formations such as tar sands and oil shale.

In recent years, hydraulic mining techniques have been developed which permit the recovery of subterranean mineral deposits by use of a high velocity liquid stream being discharged directly into the mineral deposit to dislodge the minerals from the surrounding mineral bed. The discharged liquid mixes with the freed mineral particles and forms a resultant aqueous slurry which may be pumped as by way of a hydraulic jet pump to ground surface for subsequent processing by conventional or unconventional separation systems.

To date, the majority of the prior art hydraulic mining tool apparatus have been effectively utilized to primarily recover minerals such as uranium ore or coal, which due to their generally uniform noncohesive structure, rapidly dislodge from the mineral deposit, readily migrate within the aqueous slurry, and typically transport without conglomeration, upward within the jet pump of the mining tool. However, in the recovery of viscous crude oil minerals, such as tar sands and oil shale, peculiar mining problems exist which to a great extent has rendered the heretofore hydraulic mining systems ineffective and commercially impracticable.

These peculiar mining problems are a result of the basic composition of viscous crude oil mineral formations which typically are of a non-uniform nature, varying significantly between different mineral bed sites as well as throughout the elevation of the same mineral bed site. With specific reference to tar sand mineral formations, it has been found that due to the high cohesive and adhesive properties of the bitumen constituent contained therein, the individual tar sand mineral particles often are strongly held or bound in the mineral formation and are difficult to hydraulically dislodge from the mineral bed. Similarly, when freed from the formation, such bound tar sand particles often are in the form of a gum or clay-like mass which does not readily migrate within the aqueous slurry and is highly susceptible to becoming lodged within and obstructing the internal components of the hydraulic mining tool.

In addition, due to the highly non-uniform nature of tar sand and oil shale mineral formations, the bore hole in which the mining tool is inserted, is highly susceptible to cave-in situations wherein the mineral formation falls in and around the drill string during the mining operation. These cave-in situations result in substantial frictional forces being developed in and around the mining tool and drill string which generate substantial torque on the mining tool during rotation. As such, extremely high tortional strength requirements are necessitated in tar sand and oil shale mining applications which are not typically encountered in uranium or coal formation mining.

Further, in contrast to uniform, light cohesive and adhesive mineral formations, the hydraulic mining efficiency rate in tar sand and oil shale mineral formations i.e., the amount of the mined mineral being transported to ground surface per unit of time, is typically sporadic due to the varying consistency of the mineral formation. In this regard, the majority of the prior art hydraulic mining tool systems have failed to include any means for adjusting the operation of the tool to compensate for the variances in the consistency of the formation and typically have relied solely upon natural gravity force migration of the aqueous slurry within the formation and the suction developed by the hydraulic jet pump to introduce the mined minerals into the mining tool.

Thus, there exists a substantial need in the art for a hydraulic mining tool apparatus which is specifically adapted to withstand the high tortional forces, accomodate the non-uniform, cohesive and adhesive properties, and compensate for the varying formation consistency encountered in viscous crude oil mineral formations.

SUMMARY OF THE PRESENT INVENTION

The present invention comprises an improved hydraulic mining tool and method of hydraulically mining which is specifically adapted to address and eleviate the above referenced problems associated in the hydraulic mining of viscous crude oil formations such as tar sand and oil shale. More particularly, the hydraulic mining tool of the present invention incorporates a novel modular construction wherein the major components of the mining tool, i.e., the hydraulic jet pump and cutting jet, the rock crusher, the radial slurry inlets, and the bottom slurry inlets, are formed as separate, individual units, each adapted to be interchangeably attached to one another. Each of the separate modules includes a common mounting flange arrangement which possesses sufficient structural integrity to withstand the extremely high torque conditions encountered during tar sand and oil shale mining applications. By use of this modular construction and common mounting flange arrangement the mining tool of the present invention may be readily modified to accomodate the particular mineral formation being mined with either the rock crusher, radial slurry inlet, or bottom slurry inlet modules or a combination of the same, being mounted to the jet pump eductor and cutting jet module of the mining tool to yield the most efficient mining recovery rate. Additionally, by use of the modular construction of the present invention, spare modules may be inventoried at the mining site and rapidly substituted onto the mining tool thereby reducing any period of down time of the mining operation necessitated for repair of the mining tool. Hence, the present invention permits versatility in the composite structure of the mining tool to meet the precise operational mining requirements of the mineral formation, while minimizing the time period for repair of the tool.

To augment the increased versatility and reduced down time benefits made possible by the modular construction of the mining tool, the present invention additionally incorporates means for varying the size of the radial slurry inlet openings during the mining operation, thereby permitting a proportional metering of the amount of mined material entering into the mining tool between the radial and axial slurry openings. In a first embodiment, the varying means comprises a coaxial cylinder which may be reciprocated axially within the interior of the casing of the mining tool to selectively cover and uncover the radial slurry inlets. In a second embodiment, the varying means comprises plural wicket gates, each located within one of the radial slurry inlets of the mining tool and adapted to pivot radially outward to selectively open and close the radial slurry inlets. Preferably, these wicket gates are formed having an arcuate configuration and are positioned on the mining tool to direct the mined mineral particles inwardly toward the jet pump eductor conduit during rotation of the mining tool. As such, the varying means of the present invention, provides metering as well as a positive feeding of mined material into the eductor of the mining tool which may be adjusted during the mining operation to maximize mining efficiency.

In addition, the present invention includes a feed screw sleeve assembly adjacent the axial or bottom slurry inlet of the mining tool which continuously lifts mined material upward toward the jet pump eductor, and further permits and mining tool to drill it's own hole during the mining operation. Thus, as will be recognized from the following specification the present invention provides a significantly improved hydraulic mining tool which insures that mined material is continuously fed directly into the jet pump eductor of the mining tool, irrespective of the particular consistency of the mineral deposit being mined.

DESCRIPTION OF THE DRAWINGS

These as well as other features of the present invention will become more apparent upon reference to the drawings wherein;

FIG. 3 is an enlarged partial cross sectional view of the radial slurry inlet module of the mining tool of the present invention and illustrating a first embodiment of means for varying the size of the radial slurry openings therein;

FIG. 4 is a perspective view of the radial slurry inlet module of FIG. 3 illustrating the location of hydraulic conduits extending axially adjacent the perimeter surface of the module;

FIG. 5 is an enlarged fragmentary view of the radial slurry opening varying means of FIG. 3 illustrating the detailed construction thereof;

FIG. 10 is a cross sectional view of the rock crushing module of the present invention;

FIG. 11 is a cross sectional view of a first embodiment of the axial slurry inlet module of the present invention;

FIG. 12 is a cross sectional view of the axial slurry inlet module taken about lines 12—12 of FIG. 11.

FIG. 13 is a partial perspective view of a second embodiment of the axial slurry inlet module of the present invention;

FIG. 14 is a cross sectional view of the axial slurry inlet module taken about lines 14—14 of FIG. 13; and FIG. 15 is a schematic perspective view of the axial slurry inlet module of FIG. 13.

DETAILED DESCRIPTION OF THE PREFERRED EMBODIMENT

Figure 1:
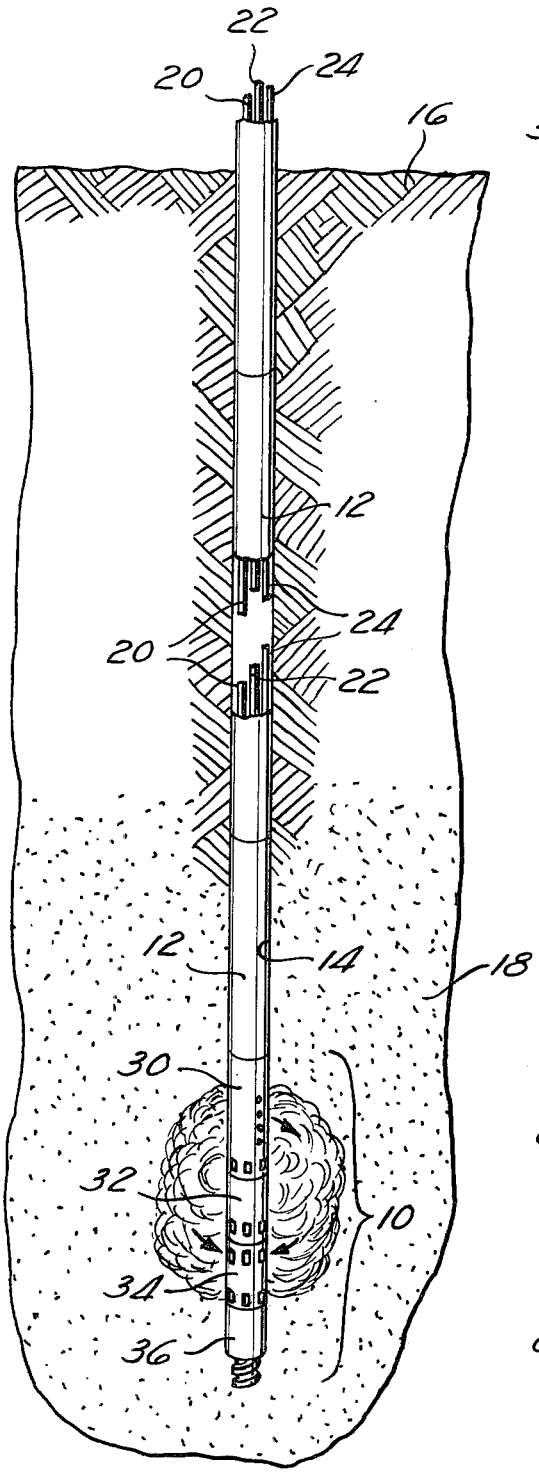
FIG. 1 is perspective view of the modular mining tool of the present invention disposed within a bore hole and connected to plural drill sections extending upward to ground surface.

Referring to FIG. 1 there is shown the modular hydraulic mining tool apparatus 10 of the present invention, connected at the upper end to plural drill sections 12 which extend upward above ground surface. The mining tool 10 is depicted in its operational mode, being lowered into a pre-existing bore hole 14 which extends through the overburden 16 and into a desired mineral formation 18, which by way of example comprises a tar sand mineral formation.

Extending axially within the interior of the drill sections 12, are a jet pump supply conduit 20, a jet pump eductor conduit 22, and a cutting jet supply conduit 24 which initiate at a height above ground surface and terminate at connections within the mining tool 10. A conventional kelly section (not shown) and a three passage swivel (not shown) is typically provided above ground surface which permits rotation of entire drill string while maintaining sealed connections of the jet pump supply conduit 20 and cutting jet supply conduit 24 with respective pumps (not shown) and the eductor conduit 24 which a surge tank or settling resevoir (not shown).

In operation, the entire drill string is rotated by conventional means from above ground surface and a high velocity liquid is introduced through the cutting jet supply conduit 24 and discharged radially outward through the mining tool 10 to dislodge tar sand particles from the formation 18. The dislodged particles form an aqueous mixture or slurry with the discharged liquid, which migrates downward within the formation 18 and into the interior of the mining 10 through the radial slurry inlets and axial slurry inlets of the tool. The aqueous slurry is subsequently lifted upward to ground surface by way of a hydraulic jet pump disposed within the interior of the mining tool, formed by the jet pump supply conduit 20 discharging a high velocity liquid vertically upward within the interior of the eductor conduit 22. For a more detailed description of the basic operation of hydraulic mining tools, reference may be made to U.S. Pat. No. 3951457 issued to Redford, and two copending patent applications Ser. No. 053029, entitled "Downhole Pump with Bottom Receptor", and Ser. No. 121712, entitled "Improved Hydraulic Mining Tool Apparatus," applied for in the name of Everett L. Hodges the assignee of the subject application, the disclosures of which are expressly incorporated herein by reference.

As depicted in FIG. 1, the mining tool 10 of the present invention is formed in a modular construction, composed of an eductor/cutting jet module 30 a rock crushing module 32, a radial slurry inlet module 34, and an axial or bottom slurry inlet module 36. Each of the modules 30, 32, 34, and 36 are removably attached to one another by use of a common mounting flange arrangement, which as will become more apparent infra, permits the rock crushing module 32, radial slurry inlet module 34, and axial slurry inlet module 36, or a combination of the same to be either mounted to or removed from the eductor/cutting jet module 30 of the mining tool 10 prior to insertion of the mining tool into the formation 18. Hence, depending upon the particular consistency of the tar sand formation i.e., sandy, clay-like or predominantly laced with rocks, the mining tool 10 may be composed of the appropriate modules 32–36 to facilitate maximum mining efficiency.

Figure 2:
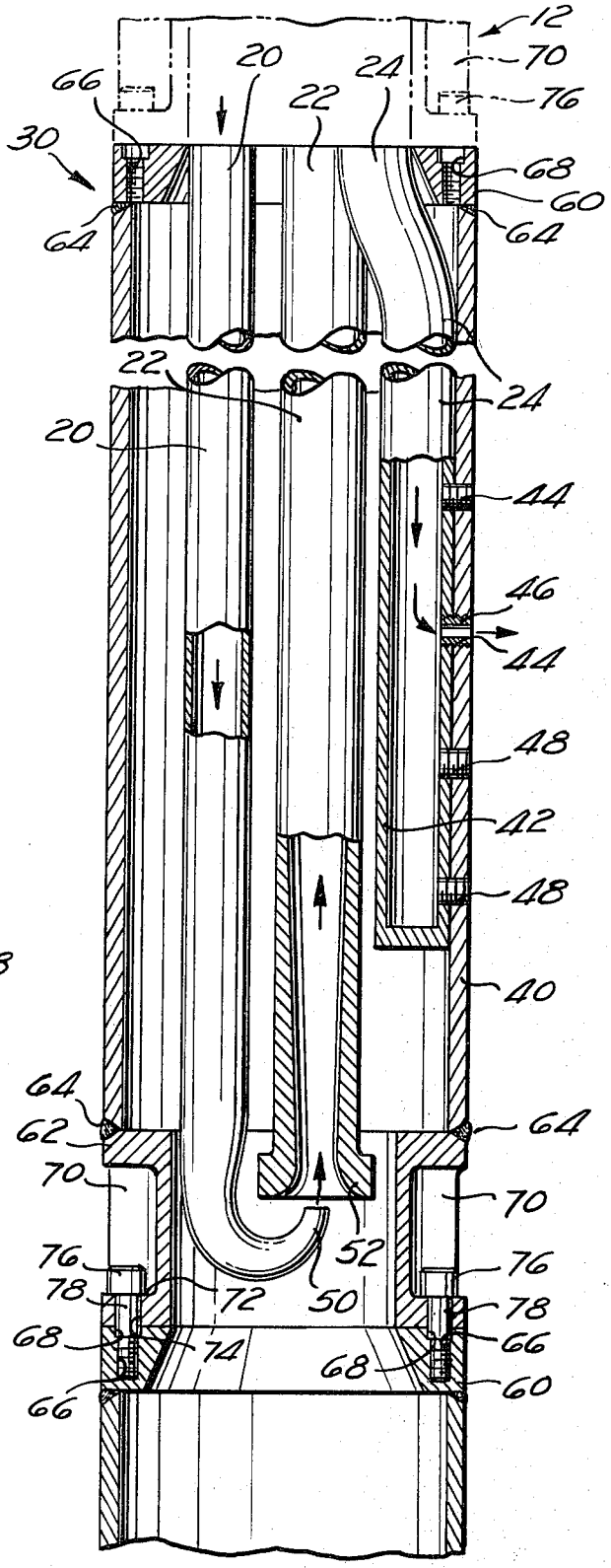
FIG. 2 is an enlarged cross sectional view of the eductor/cutting jet module of the hydraulic mining tool of the present invention illustrating the relative position of the cutting jet conduit, jet pump conduit, and eductor conduit extending within the interior of the module and depicting the common mounting flange arrangement utilized to interconnect each of the modules of the mining tool.

Referring to FIG. 2, the detailed construction of the eductor/cutting jet module 30 of the present invention may be described. The module 30 is formed in a tubular configuration having an outer cylindrical casing 40, the diameter of which is sized to be received within bore hole 14 formed in the mineral formation 18 (shown in FIG. 1) typically being 12 to 16 inches. The cutting jet supply conduit 24 initiates adjacent the upper end of the casing 40 and extends to a manifold 42 ridgedly mounted to the inside diameter of the casing 40. The manifold 42 is preferably provided with plural, axially spaced threaded apertures 44 which extend radially outward through the casing 40. Each of the threaded apertures 44 receive either a venturi nozzle 46 or a plug 48 which permits the position as well as the number of cutting jets to be adjusted prior to insertion of the tool 10 within the bore hole 14. By such as arrangement, high pressure liquid pumped from ground surface through the cutting jet conduit 24 is accelerated through the venturi nozzle 46 and discharged radially outward in the tar sands formation 18. Although in the preferred embodiment, the manifold 42 is positioned to discharge the cutting jet liquid in only a single radial direction, those skilled in the art will recognize that an additional manifold 42 may be positioned on the opposite side of the casing 40 to balance the liquid discharge or a cylindrical manifold may be utilized to facilitate liquid discharge in multiple radial direction.

The eductor/cutting jet module 30 additionally includes a jet pump supply conduit 20 and jet pump eductor conduit 22, both of which terminate at a distance slightly above the lower end of the module. As shown, the jet pump supply conduit 20 is provided with a nozzle 50 which is co-axially aligned with an eductor venturi 52 formed on the lowermost end of the eductor conduit 22. As liquid is pumped downward through the jet pump supply conduit 20, it is accelerated through the jet pump nozzle 50 and discharged upwardly through the eductor venturi 52. Upon passage through the venturi 52, a strong suction force is created in the region below the eductor venturi 52 which pulls the aqueous tar sand slurry upward into the eductor conduit 22 and subsequently drives it to ground surface.

The eductor/cutting jet module 30 as well as the remaining modules 32, 34, 36 is provided with a common upper and lower mounting flange 60 and 62 respectively, adapted to interconnect each of the separate modules 30, 32, 34, 36 and specifically designed to withstand high tortional forces. The upper flange 60 is preferably formed in a spool or annular configuration having a wall thickness substantially greater than the wall thickness of the casing 40, and is rigidly attached to the casing 40 as by way of a peripheral fillet weld 64. The upper surface of the flange 60 is provided with a plurality of threaded apertures 66 which are symetrically spaced in a bolt circle pattern and extend partially through the length of the flange 60. The upper portion of each of the apertures 66 additionally includes an increased diameter counterbore 68 which as will be explained in more detail below, serves to accurately align the mating flange 60 and 62 of adjacent modules of the mining tool.

The lower flange 62 is additionally formed as an annular spool member and is rigidly attached to the casing 40 by a peripheral fillet weld 64. A plurality of recessed pockets 70 are formed along the periphery of the flange 62 and are positioned on a bolt circle pattern corresponding with the threaded apertures 66 formed in the upper flange 60. The pockets 70 terminate at a distance spaced from the lowermost end of the flange 62 and each define a shoulder 72. An aperture 74 extends axially through each of the shoulders 72 and is aligned with a respective one of the threaded apertures 66 formed in the upper flange 60.

By such a mating flange arrangement, the individual modules 30 through 36 of the mining tool 10 maybe connected together by abuttment along their upper and lower flanges 60 and 62 respectively. Plural bolts 76 may subsequently be inserted within the pockets 70, lowered through the apertures 74 of the lower flange 62 and threaded into the threaded apertures 66 of the upper flange 60. In the preferred embodiment, the shank portion 78 of the bolts 76 is sized to be only slightly less than the diameter of the aperture 74 and counterbore 68 and is formed having a length sufficient to extend into the counterbore 68. Thus, when the bolts 76 are securely tightened in the apertures 66, the shank portion 78 of the bolts 76 accurately registers or aligns the upper and lower flanges 60 and 62 of adjacent modules together. Additionally, due to the shank portion 78 of the bolts 76 being closely sized with and extending through the aperture 74 and into the counterbore 68 of the apertures 66, the primary tortional force applied to the module interface is carried by the shank portion 78 rather than the threaded section of the bolts 76. Thus, by use of the common mating upper and lower flange arrangement of the present invention, a high and tortional integrity interconnection between each of the separate modules 30 through 36 of the mining tool is insured.

In FIG. 3 and FIG. 4, the radial slurry inlet module 34 of the present invention is illustrated. The radial slurry inlet module 34 is formed having an outer cylindrical casing, 80, opposite ends of which include the upper and lower common mounting flange, 60 and 62 respectively, which permits the radial slurry inlet module 80 to be connected to the other modules, 30, 32, and 36 of the mining tool in the manner previously described and as depicted by the phantom lines in FIG. 3. As shown, the radial slurry inlet module 34 is provided with plural oblong openings 82 adjacent its upper-most end, which are adapted to permit the aqueous mineral slurry mined by the cutting jet nozzle 46 to enter into the interior of the mining tool and be transported upward to the eductor conduit 24 of the eductor/cutting jet module 30. The openings 82 are preferably located as close to the upper end of the module 34 as possible, (i.e. minimize the distance between the opening 82 and eductor venturi 52 of the eductor/cutting jet module 30) so that frictional forces of the mined slurry within the tool are minimized and maximum eductor suction is sensed at the openings 82.

It is an important feature of the present invention that the radial slurry inlet module 34 includes means for varying the size of the slurry openings 82 during the mining operation so that the amount of mined material entering the mining tool 10 through the radial slurry inlet module 34 and axial slurry inlet module 36 may be proportionally metered to meet the immediate mining requirements of the formation. The particular means for varying the size of the radial slurry openings 82 is shown in FIG. 3 and 5 and comprises a cylindrical sleeve 86 which is hydraulically actuated to telescope axially within the interior of the casing 80 and selectively block a portion or the entirety of the radial inlet openings 82.

The sleeve 86 is formed having an outside diameter slightly less than the inside diameter of the casing 80 and includes a reduced diameter portion 88 initiating adjacent its lower end and extending approximately midway along its length. An annular shoulder 90 is formed adjacent the lower end of the sleeve 86 which as best shown in FIG. 5, locates an annular sealing ring 92 bridging between the outside diameter of the sleeve 86 and the inside diameter of the casing 80. The ring 92 is maintained against the shoulder 90 of the sleeve 86 by a split ring 94 which tightly engages a mating groove formed in the sleeve 86. A pair of O rings 96 and 98 are additionally provided to form a liquid tight seal between the casing 80 and sleeve 88.

A second sealing ring 100 bridges the gap between the casing 80 and reduced diameter portion 88 adjacent the upper end of the reduced diameter portion 88 and is maintained in a stationary position between a pair of annular shoulders 102 and 104 formed in the outer casing 80. As with the lower sealing ring 92, a pair of O rings 106 and 108 are provided to form a liquid tight seal against the reduced diameter portion 88 and casing 80. By such a structure a piston cylinder arrangement is provided with the annular voids formed between the reduced diameter section 88 and outer casing 80, located above the and below the upper sealing ring 100, defining upper and lower control chambers 110 and 112 respectively. Each of the control chambers 110 and 112 include a respective hydraulic conduit 114 and 118 which extends upward to ground surface within a recess 120 formed along the outer periphery of the casing 34 as well as on each of the remaining modules 30, 34, and 36 and drill sections 12. As shown, the hydraulic line 114 preferrably communicates with the lower control chamber 112 via a passage 113 formed in the upper sealing ring 100, whereas the hydraulic line 114 communicates with the upper control chamber 110 via passage 115.

With the structure defined, the operation of the telescoping sleeve 86 within the module 34 and the manner in which the size of the radial slurry inlet opening 82 is varied during the mining operation may be described. Referring to FIG. 3, the sleeve 86 is depicted in its lower most position wherein the lower distal end of the sleeve 86 abutts against the annular shoulder 130 formed by the increased wall thickness of the lower mounting flange 62. As will be recognized with the sleeve 86 maintained in this position, the upper end 87 of the sleeve 86 is positioned below the radial slurry inlet openings 82 and hence the inlets 82 are in a fully open condition. When it is desired to reduce the size of the radial slurry openings 82, the upper control chamber 110 may be pressurized from above ground surface, via the hydraulic conduit 114 while the lower control chamber 112 is vented via the hydraulic conduit 118, thereby causing a pressure gradient to exist across the upper sealing ring 100. This pressure gradient results in the sleeve 86 raising upward within the interior of the casing 80 (in the direction of the arrow in FIG. 3) whereby the upper end 87 of the sleeve 86 obstructs a portion or the entirety of the radial slurry openings 82. In its furthest upward extension, the upper end of the sleeve 86 abutts against a shoulder 132 formed by the increased wall thickness of the upper flange 68, thereby preventing the lower sealing ring 92 from contacting the upper sealing ring 100. Conversely, when it is desired to increase the size of the openings 82, the upper control chamber 110 may be vented while the lower control chamber 112 is pressurized, causing a reverse pressure gradient to exist across the upper sealing ring 100 whereby the sleeve 86 returns to its lower most position shown in FIG. 3. Thus, by regulating the pressure within the slurry inlet openings 82 may be selectively adjusted during the mining operation between fully open and fully closed positions to meter the amount of slurry entering into the mining tool 10 through the radial slurry inlets 82.

Figure 6:
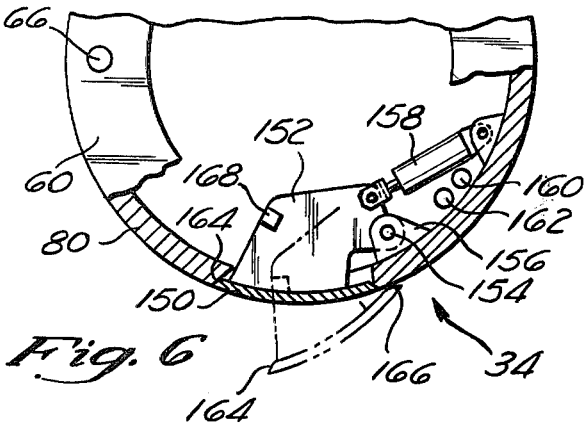
FIG. 6 is a partial cross sectional view of the radial slurry inlet module depicting a second embodiment of means for varying the size of the radial slurry openings wherein a hydraulically actuated wicket gate is positioned within each of the radial slurry openings.
Figure 7:
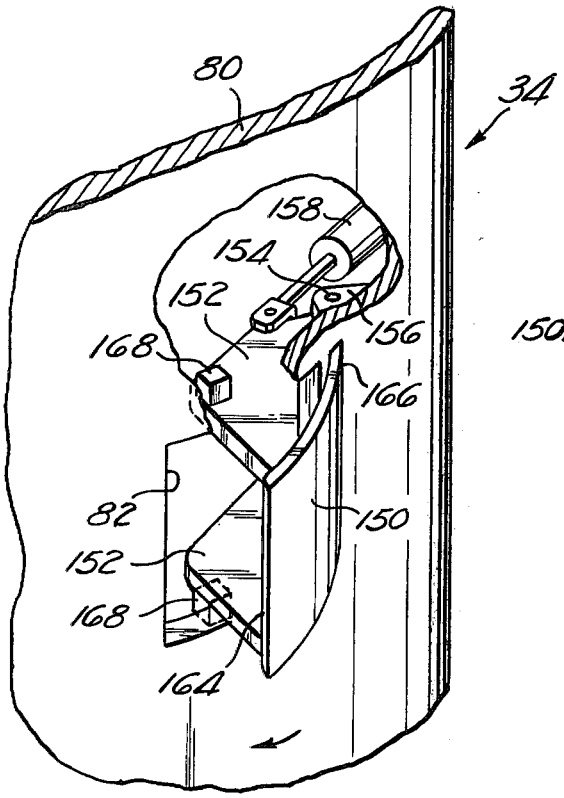
FIG. 7 is a perspective view of the wicket gate structure of FIG. 6 depicting the gate in a fully open position.

In FIG. 6 and 7, an alternative means for adjusting the size of the openings 82 of the radial slurry inlet module 34 is depicted which, additionally serves to direct or feed mined materials into the eductor venturi 52 of the mining tool 10. In this embodiment, the reciprocating sleeve 86 is replaced by plural wicket gates 150, each disposed within a respective one of the slurry openings 82. As shown, the wicket gates 150 are preferably formed having an arcuate exterior surface configuration consistent with the curvature of the outer casing 80 of the module and are sized to be received within the openings 82.

A pair of generally L-shaped struts 152 are rigidly attached to the interior surface of the wicket gates 150 and extend radially inward within the interior of the casing 80. As best shown in FIG. 6, both of the struts 152 are pivotally connected as by way of a pin 154 to a pair of hinges 156 located at a distance spaced from the side edge of the slurry inlet opening 82. The struts 152 are additionally connected to a respective hydraulic actuator 158 which is positioned relative the struts 152 and casing 80 to cause the wicket gates 150 to pivot about the pins 154. Each of the actuators 158 may be connected to a pressure source located above ground by a variety of conventional means but, for purposes of illustration, a pair of hydraulic conduits 160 and 162 (illustrated in FIG. 6) are provided, which extend axially through the interior of the module 34 as well as the remainder of the drill string.

In operation, selective pressurization of the hydraulic actuators 158 causes each of the wicket gates 150 to pivot from a closed position (shown by the full lines in FIG. 6) to a fully open position shown in FIG. 7. Due to the pivot pins 154 being positioned adjacent the side edge of the inlet opening 82, during this pivotal movement, the leading edge 164 of the gates 150 travels radially outward at a substantially greater distance than the trailing edge 166 of the gates, whereby the gates serve as funnels or scoop-like members extending about the pheriphery of the casing 80. Thus during rotation of the mining tool 10 in the direction indicated by the arrow in FIG. 7, the wicket gates 150 serve to direct the mined mineral material along their inner surface into the interior of the radial slurry inlet module 34. To prevent any over-extension of the hydraulic actuator 158 as well as to prevent the wicket gates 150 from being inadvertantly torn off the module 34 during rotation of the mining tool 10, a pair of stops 168 are rigidly mounted to each of the L-shaped struts 152 and are adapted to abutt the interior surface of the casing 80. In the preferred embodiment, the hydraulic actuators 158 may be controlled from above ground surface to permit the wicket gates 150 on each of the radial slurry inlet openings 82 to be positioned at any pivotal location between their fully open and fully closed positions. Thus, by use of this wicket gate arrangement, mined material is effectively fed or forced into the interior of the module 34 at a rate controlled and regulated from above ground during the mining operation.

Figure 8:
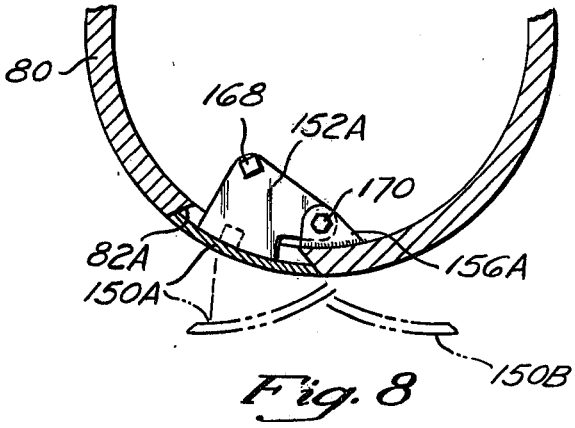
FIG. 8 is a partial cross sectional view of a modified wicket gate structure for use on the radial slurry inlet module of the present invention.
Figure 9:
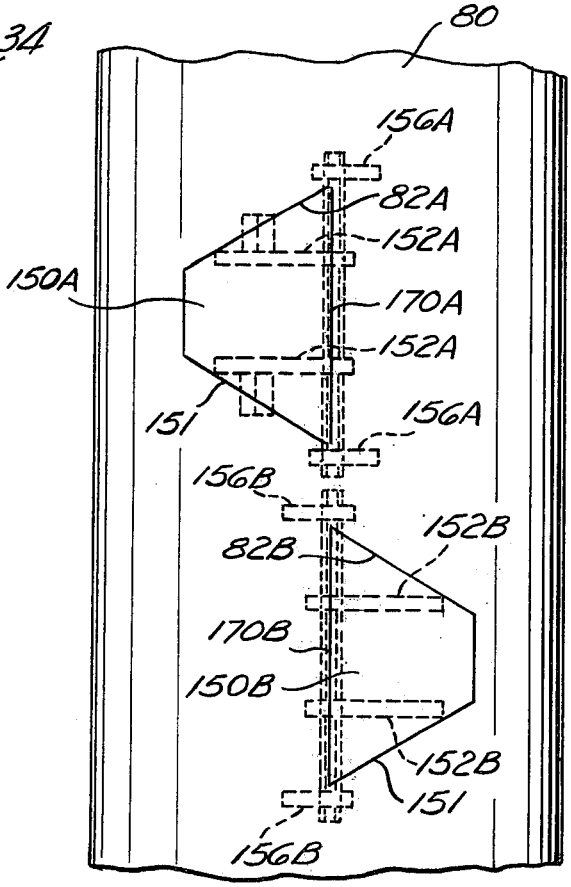
FIG. 9 is a partial perspective view of the modified wicket gate structure of FIG. 8 depicting the gates in a closed position.

FIG. 8 and FIG. 9 depict a modification of the wicket gate construction of FIG. 6 and 7 which is specifically adapted for rotation of the mining tool in both the clockwise and the counter-clockwise direction and which further alleviates the requirement of a separate hydraulic actuator on each of the wicket gates. As best shown in FIG. 9, in this modification, the plural inlet opening 82 of the module 34 are positioned in pairs 82A and 82B which are vertically off-set from one another along the length of the module 34. In the preferred embodiment, the openings 82A and 82B are formed in a truncated triangular configuration and each receive a complementary shaped wicket gate 150A and 150B. As with the wicket gates 150 of FIG. 6 and 7, the wicket gates 150A and 150B each include a pair of L-shaped mounting struts 152A and 152B which are pivotally connected to a pair of hinges 156A and 156B rigidly mounted to the casing 80 of the module 34. In contrast to the pivot pin mounting of the gates 150 in FIG. 6 and 7, the wicket gates 150A and 150B are mounted to the hinges 156A and 156B by tortion bar 170A which is pre-torqued to normally bias the wicket gates 150A and 150B into an open position indicated by the phantom lines in FIG. 8.

By this particular arrangement, when the mining tool 10 is initially inserted within the bore hole 14 (shown in FIG. 1) the lower inclined edge 151 of the truncated triangular configuration of the wicket gates 150A and 150B serves as a cam surface against the bore hole and urges the gates 150A and 150B radially inward toward the axis of the module 34. When the camming force overcomes the outward biasing force of the tortion bar 170, the wickets gates 150A and 150B move inward in a closed position indicated by the full line position in FIG. 8. Once the tool has been inserted into the bore hole, during rotation in a clockwise direction, the wicket gates 150A are biased outward by the tortion bar 170 and maintained in an open position to direct mined mineral slurry inward within the interior of the module 34, while the wicket gates 150B are driven to a closed position. Conversely, when the mining tool 10 is rotated in a counterclockwise direction, the wicket gate 150B moves to its open position while the wicket gate 150A is driven to a closed position. Thus, by use of the modified wicket gate design of FIGS. 8 and 9, a positive feeding action of mined slurry within the interior of the radial slurry inlet module 34 is facilitated without the necessity of hydraulic actuation.

In FIG. 12, the rock crushing module 32 of the present invention is depicted which is typically disposed between the eductor/cutting jet module 30 and the radial slurry inlet module 34 of the mining tool 10 to insure the mined mineral and rock particles traveling into the eductor conduit 22 are of a size sufficient to pass upward into the venturi 52 without becoming lodged therein. As shown, the module 32 includes a cylindrical casing 200 which is provided with an upper and lower common mounting flange 60 and 62 formed in the manner as heretofore described. Disposed within the interior of the casing 200 is a fixed jaw 202 and movable jaw 204 which are positioned on opposite sides and proximal to a central throat or passage 206. The movable jaw 204 is pivotally mounted about a pin 208 securely anchored to the casing 200 and is provided with a suitable linkage 210 which extends to a hydraulic actuator 212.

In operation, reciprocation of the hydraulic actuator 212 causes the movable jaw 204 to pivot about the pin 208 and move across the opening of the throat 206 toward the stationary jaw 202. During this movement, any rock or large particulate matter lodged at the lower end of the throat 206 is crushed upon impact between the movable jaw 204 and reduced in size. Upon repeated cyclic movement of the movable jaw 204, the rocks and particulate matter reduce to a size sufficient to pass through the throat 206 and upward into the eductor cutting jet module 30. As will be recognized, by sizing the opening of the throat 206 to be slightly less than the minimum diameter of the eductor venturi 52, mined mineral particles and rock particles may travel freely through the eductor venturi 52 and upward through the eductor conduit 22 to ground surface.

Those skilled in the art will recognize that the reciprocation speed and frequency cycle of the movable jaw 204 may be controlled by conventional techniques to permit the jaw crusher to be adjusted to suit the particular composition of the mineral formation. For instance, in formations known to have a large quantity of hard rock particles, the jaw crusher module 32 may be set to provide high impact forces and rapid reciprocation cycles to throughly crush all particles entering therein; whereas in formations having a predominantly gum-like tar consistency, the impact force and reciprocation cycles may be lowered to probide a mashing action. Thus, by use of the rock crushing module 32 of the present invention, blockage of the eductor venturi 52 of the mining tool 10 may be subtantially eliminated in a simple yet effective manner.

FIG. 11 and 12 depicts the axial or bottom slurry inlet module 36 of the present invention which is preferably positioned to be the lowermost or end module on the composite mining tool 10. As with the other modules 30, 32 and 34, the axial slurry inlet module 36 includes a cylindrical outer casing 220 having an upper common mounting flange 60 rigidly attached to its upper distal end. Positioned coaxially within the interior of the casing 220 is a feed screw or auger 222 which preferably extends a short distance beyond the lower distal end 224 of the casing 220 to be disposed within the mineral formation 18 (FIG. 1). As shown, the feed screw 224 is provided with plural support fins 226 adjacent its upper end which are rigidly mounted as by a fillet weld, to the inside periphery of the mounting flange 60. As such, during rotation of the mining tool 10, the outer casing 220 and feed screw 222 of the axial inlet module 36 rotate in unison.

To eliminate any shearing off of the mined material 18 during transport along the length of the feed screw 222, the axial inlet module 34 additionally includes a shroud or sleeve 230 which surrounds the screw 220 and is adapted to remain substantially stationary or rotate slowly in direction opposite to the rotation of the module 36. As shown in FIG. 11, the shroud 230 is formed as a cylindrical tube having an outside diameter sized slightly less than the inside diameter of the casing 220 and an inside diameter sized slightly greater than the maximum diameter of the feed screw 222. Suitable bearings 232 and 234 are provided along the perimeter of the shroud 230 to insure the coaxial alignment and permit relative rotational movement between the shroud 230 and casing 220.

The upper end of the shroud 230 includes a reduced diameter section 236 which is spaced radially inward from the casing 220. The section 236 is sealed by suitable means 238 and 240 to the inside diameter of the upper mounting flange 60 and the inside diameter of the casing 220 respectively, to define an annular shroud rotation chamber 242. As best shown in FIG. 12, a plurality of substantially "S" shaped vanes 244 are affixed to the perimeter surface of the reduced diameter section 236 and extend generally radially outward across the annular chamber 242 toward the inside cylindrical wall of the casing 220. The vanes 244 are preferably formed of a flexible material such as rubber or canvas and are sized to extend axially throughout the length of the annular chamber 242.

An inlet conduit 250 and outlet conduit 252 extend axially through the upper common mounting flange 60 and into the annular shroud rotation chamber 242. As shown in FIG. 12, the inlet conduit is located at approximately a nine o'clock position on the flange 60 while the outlet conduit is located at approximately a twelve o'clock position. Disposed between the inlet and outlet conduits 250 and 252 respectively, (i.e. at the ten through eleven o'clock position) is a barrier wall 254 which extends axially throughout the height of the annular chamber 242. The barrier is rigidly mounted to the inside cylindrical wall of the casing 220 and at its maximum radial dimension is slightly spaced from the cylindrical wall of the reduced diameter section 236 of the shroud 230. As such, the barrier 254 requires water or other liquid being introduced through the inlet conduit 250 to travel in a counter-clockwise direction (as viewed in FIG. 12) through the annular chamber 242 prior to exiting through the outlet conduit 252.

With the structure defined, the operation of the shroud 230 of the module 36 may be described. As will be recognized during the mining operation, the outer casing 220 and feed screw 222 of the module rotate in a clockwise direction indicated by the arrow in FIG. 12. During this rotation, the shroud 230 will rotate with the casing 220 unless and until an arresting force is applied to the shroud 230 in an opposite (i.e. counter-clockwise) direction. This arresting force is generated by the introduction of a high pressure liquid (from ground surface or tapped from the cutting jet conduit 24 or jet pump conduit 20) through the inlet conduit 250 which upon entering the annular chamber 242, is directed by the barrier 254 to flow in a counter-clockwise direction toward the outlet conduit 252. As the high pressure liquid flows through the chamber 242, it impinges and builds up pressure upon the plural "S" shaped vanes 244, sealing their distal ends outward against the cylindrical wall of the casing 220 and imparting a counter-clockwise rotational force to the vanes 244 (as indicated by the arrows in FIG. 12) which is transmitted to the reduced diameter portion 236 of the shroud 230. As the individual vanes 244 of the shroud 230 rotate past the outlet conduit 252 the pressure behind them is vented or wasted through the conduit 252 which allows them to collapse upon contact with the barrier 254.

As such, the vanes are urged against the cylindrical wall of the reduced diameter portion 236 of the shroud 230 and pass harmlessly beyond to be again impinged upon by the incoming liquid at the inlet conduit 250.

When the liquid discharged into the annular chamber generates a counter-clockwise rotational speed on the shroud 230 which is equal to the clockwise rotational speed of the outer casing 220 and feed screw 222, the shroud is stationary within and relative to mineral formation 18 (FIG. 1). Thus, as mined mineral material is contacted by the lower end of the feed screw 222, it is urged outward against the stationary shroud 230 and lifted upward along the length of the screw 222 toward the eductor venturi 52 of the eductor/cutting jet module 30 (FIG. 1). To assist this upward transport within the shroud 230, plural elongate obstruction bars 256 are provided along the interior of the shroud 230 which prevent the rotation of the mined materials during travel on the feed screw 222.

As will be recognized, by raising the pressure of the liquid discharged into the annular chamber 242, the counter-clockwise rotational speed of the shroud 230 may be increased to exceed the clockwise rotational speed of the casing 220 which has the same result as increasing the rotational speed of the feed screw 222. As such, a supercharging effect may be provided which significantly increases the amount of mined material entering axially upward through the module 36 without increasing the rotational speed of the mining tool 10 within the formation.

In addition to the forced feeding and supercharging effect produced by use of the axial slurry inlet module 36, the use of the axial slurry inlet module 36 permits a novel hydraulic mining method wherein the mining tool itself may form its own bore hole within the mineral formation. Specifically, as previously mentioned, during the hydraulic mining process, the mineral formation is highly susceptible to cave-in situations wherein the mineral formation falls in and around the drill string and mining tool 10. Heretofore, when such a cave-in occured, and it was necessary to remove the mining tool 10 out of the formation for repair or inspection, mineral settling within the borehole prevented the mining tool 10 from being re-inserted back into the mineral formation. Similarly, due to the mineral formation in the vacinity of the bore hole being saturated with liquid from the previous hydraulic mining operation, the bore hole failed to possess sufficient integretity to permit conventional drilling apparatus such as a tri-cone bit or mud turbine, which require the re-circulation of drill tailings upward to ground surface about the annulus of the bore hole to be utilized. Hence, due to the failure of existing apparatus to remove the tailings from the formation, it was necessary to abandon the drill site and begin the mining operation at a new location.

The present invention, by use of its axial slurry inlet and screw feed, eliminates this deficiency by providing for the removal of the drill tailing to ground surface within the eductor conduit. As such, the mining tool 10 of the present invention may be readily lowered back into the mineral formation with the feed screw raising the drill tailings upward to the eductor venturi such that the mining tool re-drills its own bore hole. Thus, the present invention is specifically adapted to efficiently mine tar sand formations which heretofore was impracticable or impossible in the art.

In FIG. 13 through 15, an additional embodiment of the axial slurry inlet module 36 of the present invention is depicted which is additionally adapted to provide a substantially stationary shroud surrounding the feed screw. As shown, the module 36 is formed having an outer cylindrical casing 260 including an upper common mounting flange 60 attached to its upper end. A feed screw 262 is coaxially positioned within the interior of the casing 260 and is rigidly mounted to the upper flange 60 by way of a three arm spider web flange 264. A shroud 266 is journaled to the interior of the casing 260 to permit relative rotational movement there between, and extends axially below the casing 260 and beyond the end of the feed screw 262. An optional dome cap 294 (indicated by phantom lines) may additionally be mounted to the lower end of the shroud 266 to facilitate easy lowering of the module 36 into the bore hole 14 (FIG. 1).

As shown, the shroud 266 is provided with plural inlet apertures 270 adjacent its lower distal end which are adapted to permit mined slurry material to enter within the interior of the shroud 266 and be contacted by the feed screw 262. Although not shown, these apertures 270 may be provided with a telescoping sleeve assembly similar to that shown in FIG. 3 to permit the size of the openings to be adjusted during operation. A pair of arcuate shaped arm members 272 are additionally provided each pivotally mounted about an axial hinge 274 located along the outer periphery of the shroud 266. As shown in FIG. 14, the arm members 272 are adapted to be selectively extended radially outward from their closed position (indicated by the phantom lines in FIG. 14) to a fully opened position (indicated by the full lines in FIG. 14). In their fully opened positioned, the arcuate arm members provide a substantial surface area which, as will be explained in more detail infra, serves as a dynamic brake to maintain the shroud substantial stationary in the mineral formation 18 during rotation of the mining tool 10.

The particular mechanism for selectively opening and closing the arcuate arm members 272 is best shown in FIG. 13 and 14. As shown, each of the arm members 272 are provided with a supporting rib 280 adjacent their lower edge which includes a bell crank portion 282 which extends radially within the interior of the shroud 266. A bearing pin 284 is rigidly mounted to each of the bell crank portions 282 and is received within a respective elongate slot 286 formed in an actuator plate 288. The actuator plate 288 is rotatably mounted upon a pedestal 290 which is rigidly affixed to the lower distal end of the shroud 266 by a end plate flange 292. A pair of hydraulic operators 296 are provided on opposite sides of the axis of the actuator plate 288 and are pivotally mounted at one end to the cylindrical wall of the plate as by way of a pin 298. Suitable hydraulic lines (not shown) may be connected to each hydraulic operator 296 and extend upward within the interior of the module 36 as well as the remaining modules of the mining tool 10 and drill string to ground surface to permit the selective actuation of the operators 296.

By such a structure, it will be recognized that actuation of the hydraulic operators 296 will cause a rotational movement of the actuator plate 288 about its central axis. Due to the bearing pins 284 being engaged within the elongate slots 286 of the actuator plate 288, during rotational movement of the plate 288, each of the bell crank portions of the supporting ribs 280 travel in an arcuate path within the interior of the shroud 266 causing a corresponding pivotal movement of the arcuate arm members between an open and closed position.

As will be recognized, during the actual mining operation, wherein the outer casing 260 and feed screw 262 rotate in a clockwise direction, the arcuate arm members 272 may be hydraulically actuated into an open position (in the manner previously described). Due to the substantial surface area of the arm members 272 a substantial drag force or resistance is developed on the arm members 272 which serves as a dynamic brake to maintain the shroud 266 in a substantially stationary position within the mineral formation or at least reduce the clockwise rotational speed of the shroud 266. As such, mined slurry material entering into the module 36 through the inlet apertures 270 may be transported upward along the length of the feed screw 262 toward the eductor venturi 52 of the eductor/cutting jet module 30. Alternatively, when it is desired to remove the mining tool 10 out of the formation 18, the hydraulic operators may be actuated in the opposite direction, causing the arm members 272 to return back to the closed position tightly against the perimeter of the shroud 266.

Thus, from the above it will be recognized that each of the separate modules or a combination of one or more of the separate modules may be mounted or removed from the mining tool 10 to yield a most efficient mining recovery rate for the particular mineral formation being mined. In addition, due to the present invention adjustable sized radial slurry inlets, the inconsistent recovery rates heretofore associated with hydraulic mining may be substantially reduced. Further, due to the present invention providing a positive feeding of material both through the axial as well as radial slurry openings, the mining tool of the present invention insures that mined materials are continuously being transported from the bore hole upward to ground surface. Thus, in summary, the present invention provides the significantly improved hydraulic mining tool and method of operating the same which is specifically adapted for viscous crude oil mineral formations such as tar sand and oil shale formation.

What is claimed is:

1. An improved hydraulic mining tool for recovering mineral bearing materials from subterranean deposits comprising:

a cylindrical casing formed of plural discrete modules, each sized to be received within a bore hole formed in said subterranean deposit;

a hydraulic cutting jet and an eductor pump disposed within a first one of said plural modules;

a radial inlet formed on a second one of said plural modules to direct said mineral bearing material radially into the interior of said casing;

an axial inlet formed on a third one of said plural modules to direct said mineral bearing material axially within the interior of said casing; and common mounting means formed on each of said modules for interchangeably connecting said plural modules in a selective coaxial orientation adapted to meet the particular formation consistency of said subterranean deposit.

2. The hydraulic mining tool of claim 1 wherein said common mounting means comprises:

a flange mounted on opposite ends of said discrete modules, each of said flanges including plural apertures positioned in a mating bolt circle pattern; and plural fastening means sized to be received within said apertures for removably attaching said flanges together on adjacent ones of said plural modules.

3. The hydraulic mining tool of claim 1 wherein said second one of said plural modules additionally includes means for varying the size of said radial inlet to meter the amount of said mineral bearing material entering into the interior of said casing during the mining operation.

4. The hydraulic mining tool of claim 3 wherein said means for varying the size of said radial inlet further includes means for positively feeding said mineral bearing material into the interior of said casing.

5. The hydraulic mining tool of claim 4 wherein said feeding means comprises at least one gate pivotally mounted to said second one of said plural modules adjacent said radial inlet and movable radially outward from said module.

6. The hydraulic mining tool of claim 3 wherein said varying means comprises a sleeve coaxially positioned within said second one of said plural modules and adapted to reciprocate axially along the length of said module.

7. The hydraulic mining tool of claim 1 wherein said third one of said modules further includes means for feeding said mineral bearing material through said axial inlet.

8. The hydraulic mining tool of claim 7 wherein said feeding means comprises an inclined plane screw extending within the interior of said third one of said modules.

9. The hydraulic mining tool of claim 1 further comprising:

means for crushing said mined mineral bearing material, said means disposed within a fourth one of said plural tubular modules.

10. An improved hydraulic mining tool apparatus for the recovery of mineral bearing materials from subterranean deposits comprising:

a drill string adapted to rotate within a bore hole extending from ground surface into said deposit;

a mining tool mounted on one end of said drill string and disposed within said deposit;

a hydraulic cutting jet positioned on said mining tool for dislodging said mineral bearing material from said deposit and forming a resultant mineral bearing slurry;

a pump located on said mining tool for transporting said resultant mineral bearing slurry through said drill string to ground surface;

inlet means formed on said mining tool for permitting said mineral bearing slurry to enter into said mining tool and travel toward said pump; and means mounted to said mining tool for metering the amount of said mineral bearing slurry entering into said mining tool during the mining operation.

11. The hydraulic mining tool apparatus of claim 10 wherein said inlet means comprises at least one opening formed through said mining tool and said metering means comprises a coaxial sleeve positioned within the interior of said mining tool and adapted to selectively reciprocate axially within said tool to varying the effective size of said opening.

12. The hydraulic mining tool of claim 10 wherein said inlet means comprises at least one opening formed through said mining tool and said metering means comprises a gate pivotally mounted within said at least one opening and movable radially outward from said mining tool to vary the effective size of said opening.

13. The hydraulic mining tool apparatus of claim 12 wherein said gate is located to direct said mineral bearing slurry through said at least one opening.

14. An improved hydraulic mining tool apparatus for the recovery of mineral bearing material from subterranean deposits comprising:

a drill string adapted to rotate within a bore hole extending from ground surface into said deposit;

a mining tool mounted on one end of said drill string and disposed within said deposit;

a hydraulic cutting jet positioned on said mining tool for dislodging said mineral bearing material from said deposit and forming a resultant mineral bearing slurry;

a pump located on said mining tool for transporting said mineral bearing slurry through said drill string to ground surface;

an inlet opening formed on one end of said mining tool to axially receive said mineral bearing slurry within the interior of said mining tool;

an inclined plane auger mounted to said mining tool and extending axially through said inlet opening to be partially disposed within said formation;

a shroud extending about said auger and rotably mounted to said mining tool to permit relative rotational movement between said auger and said shroud; and means for maintaining said shroud substantially stationary within said deposit during rotation of said drill string; said auger, shroud and maintaining means cooperating together to transport said mineral bearing slurry without shear-off through said inlet opening.

15. The hydraulic mining tool of claim 14 wherein said maintaining means comprises means for rotating said shroud in an opposite direction and at substantially the same speed as the rotation of said drill string.

16. The hydraulic mining tool of claim 14 wherein said maintaining means comprises a retractable dynamic brake mounted to said shroud.

17. An improved hydraulic mining tool for recovering mineral bearing materials from subterranean deposits comprising:

a casing formed of plural discrete modules, each sized to be received within a bore hole extending from ground surface into said subterranean deposit;

a hydraulic cutting jet and a pump carried on a first one of said plural modules, said cutting jet positioned to dislodge said mineral bearing material from said deposit and form a resultant mineral bearing slurry and said pump adapted to transport said mineral bearing slurry from said deposit to ground surface;

inlet means formed on a second one of said modules for allowing entry of said mineral bearing slurry into the interior of said casing and toward said pump;

means formed a third one of said modules for crushing said mineral bearing slurry; and common mounting means formed on each of said modules for interchangeably connecting said plural modules in differing axial orientations to vary the composite structure of said mining tool to meet the particular mining requirements of the subterranean deposit.

18. The hydraulic mining tool of claim 17 further comprising means formed on said second module for metering the amount of said mineral bearing slurry entering into the interior of said casing.

19. The hydraulc mining tool of claim 18 further comprising means formed on said second module for forcibly feeding said mineral bearing slurry into the interior of said casing.

* * * * *